United States Patent [19]

Rodd

[11] Patent Number: 4,498,623

[45] Date of Patent: Feb. 12, 1985

[54] HOT WATER HEATING SYSTEM

[75] Inventor: Derek E. Rodd, San Anselmo, Calif.

[73] Assignee: Minitube Systems, San Anselmo, Calif.

[21] Appl. No.: 339,306

[22] Filed: Jan. 15, 1982

[51] Int. Cl.[3] ..... F24D 3/00

[52] U.S. Cl. ..... 237/8 R; 237/56; 237/59

[58] Field of Search ..... 237/8 R, 56, 59; 236/9 A

[56] References Cited

U.S. PATENT DOCUMENTS

| | | | |
|---|---|---|---|
| 1,993,685 | 3/1935 | Rosenblad | 237/56 |
| 2,652,069 | 9/1953 | Goheen | 237/56 |
| 3,078,044 | 2/1963 | Brandl | 237/56 |
| 3,515,345 | 6/1970 | Barnd | 237/56 |
| 3,986,666 | 10/1976 | Rietti | 237/59 |

FOREIGN PATENT DOCUMENTS

| | | | |
|---|---|---|---|
| 391207 | 6/1908 | France | 237/56 |

*Primary Examiner*—Henry Bennett
*Attorney, Agent, or Firm*—Melvin R. Stidham

[57] ABSTRACT

A hot water heating system is disclosed in which the convectors or radiators are provided with thermostatic valves capable of shutting off the supply water to all radiators. In order to prevent damage to the pump some circulation is permitted at all times by means of a bypass opening in a manifold which directs water to and from the radiators.

8 Claims, 3 Drawing Figures

HOT WATER HEATING SYSTEM

This invention relates to a hot water heating system and more particularly to the general type of system disclosed in British Pat. Nos. 1,180,462 and 1,180,463.

In said patents a system is disclosed in which a unitary manifold is employed to direct water to and from a plurality of radiators or convectors. The British system has many advantages including the fact that because of the relatively small diameter of the flexible tubing employed and the use of a relatively small manifold very little space is required for the installation.

In addition, the relatively long lengths of the very flexible tubing employed permits bending the tubing as required thereby obviating fittings and potential leaks.

Another advantage is that the system may readily be installed in an existing building because the small diameter of the tubing obviates problems of interference with existing structures.

Referring again to the above cited British patents, the same disclose the use of shut off valves at each radiator which may be manually set so that each radiator may emit the particular amount of heat desired. In such an installation it is necessary to leave at least one valve open so as to permit the pump to circulate some water to prevent damage to the pump.

One of the improvements provided by the present invention is to permit the use of thermostatic valves at the radiators so that a manual operation is not required and a particular setting of the thermostatic temperature sensing valve may be made and continuously maintained.

In addition, the present invention provides a simple by-pass that permits constant circulation of water by the pump even though all of the temperature responsive valves may have automatically closed.

Other advantages will be apparent from the following specification and drawings.

Figure 1:
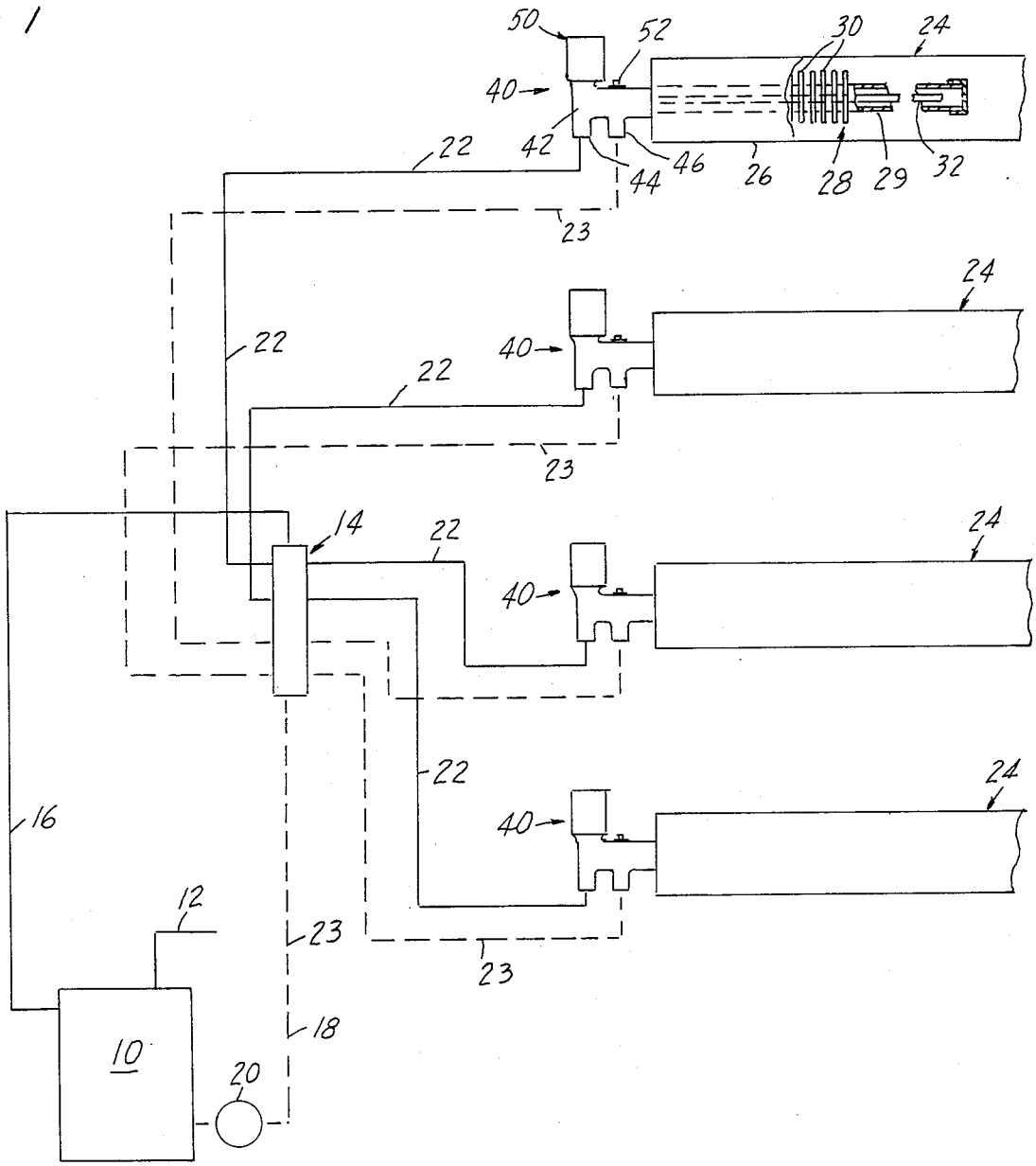
FIG. 1 is a simplified schematic of the system in which the tubing is represented by one line to simplify the drawing.

Referring first to FIG. 1 a water heating means such as a boiler, gas heater or similar device is indicated at 10 and which means is supplied by a water line 12. In the drawings the supply conduits to the radiators are indicated by solid lines and the return conduits by dotted lines.

A manifold generally designated 14 is supplied with hot water by conduit 16 and said manifold returns the cooler water to the heating device 10 by conduit 18. A circulating pump 20 is preferably mounted in return conduit 18.

The manifold 14 in FIG. 1 is provided with four supply lines 22 which are respectively connected to four radiators or convectors 24. However it will be understood that many more radiators may be supplied by one manifold. In fact it is not unusual for each manifold to supply six or more radiators. It will further be understood that the relationship of the radiators of FIG. 1 is also simplified and that the radiators may be in different rooms and much more widely spaced apart than shown in FIG. 1. The return tubes are indicated by dotted lines at 23.

As best seen in FIG. 1 in which one convector housing is broken away to show the heat exchange element, each convector includes a suitable housing 26 and an elongated heat exchange element 28. Each heat exchange element 28 includes an elongated tube 29 provided with heat transfer fins 30 and a return tube 32 of lesser diameter mounted within tube 28.

Controlling flow of water to and from each convector 24 is a valve assembly generally designated 40. The valve body 42 of said assembly is conventional and no claim is made thereto except in combination with the remainder of the invention. Said valve body includes an inlet port 44 communicating with tube 29 and a return port 46 communicating with return tube 32.

The present practice is to provide a manually operable shut off valve in valve body 42. However by the present invention a thermostatic valve 50 is provided in said body which opens and closes the supply line 22 in response to changes in the ambient temperature in the room. Such a thermostatic valve is conventional and can be manually set to achieve whatever temperature is desired in the room to be heated.

The conventional valve body usually also includes an adjustment screw 52 which can be used to regulate the flow in return line 23 thereby regulating the volume of water flow so as to balance the relative flow among the various convectors.

Figure 2:
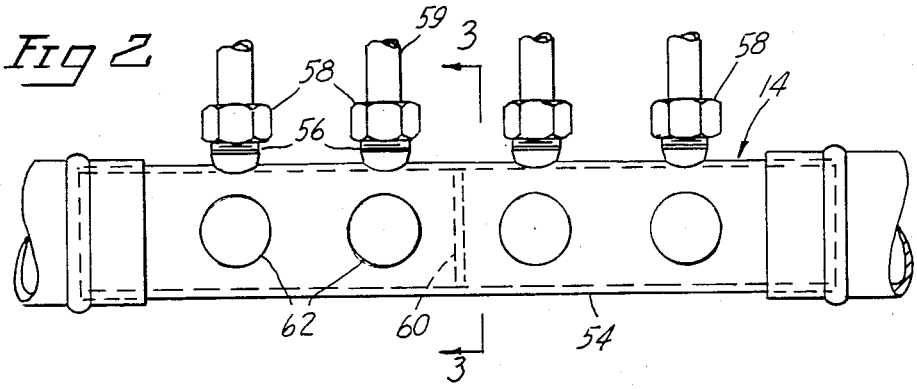
FIG. 2 is a side elevation of the manifold.
Figure 3:
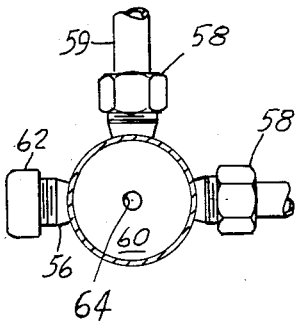
FIG. 3 is a cross section taken in a plane represented by lines 3—3 of FIG. 2.

Referring now to FIGS. 2,3 the manifold 14 comprises a length of copper tube 54 which is preferably $\frac{3}{4}''$ diameter or 1" diameter and of a length which depends on the number of parts desired. Integrally mounted on said tube 54 are a plurality of externally threaded ports 56 which are adapted to threadedly receive compression fittings 58 for connecting $\frac{3}{8}''$ diameter tubing 59.

Centrally mounted within tube 54 is a circular wall 60 (FIG. 3) which divides the manifold into a supply portion and return portion of equal size.

In FIG. 2 four supply ports and four return ports are connected to $\frac{3}{8}''$ diameter tubing 59 to agree with FIG. 1. The remaining ports may be closed by caps 62 so as to provide for additional use in the future.

By the present invention, to prevent damage to the pump 20 in the event that all of the thermostatic valves 50 are closed, a relatively small hole 64 is formed in wall 60 of the manifold 14 (FIG. 3). For a 1" diameter copper tube forming said manifold the diameter of the hole 64 is preferably $\frac{1}{2}'$. However this diameter may be reduced to about 3/32" or increased to about 9/32" and still give satisfactory results.

In other words the inside area of the manifold should be from about ten to 100 times the area of hole 64 and is preferably about 60 times. The amount of circulation thus permitted when one or more of the thermostatic valves 50 are open is relatively small and does not appreciably affect the efficiency of the system.

I claim:

1. A forced circulation heating system comprising:

water heating means, a radiator, a manifold, a supply conduit connected from said heating means to said supply chamber and a return conduit connected from said return chamber back to said heating means.

a divider wall across manifold to form a supply chamber and a return chamber on opposite sides thereof, a supply duct connecting said supply chamber to the inlet of said radiator, a return duct connecting the outlet of said radiator to said return chamber, said divider wall being formed with a relatively small aperature therethrough positioned to permit the restricted passage of water directly from said supply chamber to said return chamber.

2. A system according to claim 1 wherein a thermostatic valve is applied to the supply conduit connecting said manifold and radiator for controlling the flow of water to said radiator.

3. A system according to claim 2 wherein said thermostatic valve includes shut off means for stopping flow of water to said radiator.

4. A system according to claim 1 wherein the area of said opening is less than one twelfth the area of said wall.

5. A system according to claim 1 wherein the area of said opening is about one sixty fourth of the area of said wall.

6. A manifold for installation in a hot water heating system comprising:

a tubular body;

a divider wall across said body intermediate the ends thereof to form supply and return chambers on opposite sides thereof;

the supply and return chamber ends of said body being adapted for connection respectively to the supply and return lines of a water heating device;

at least two supply ports opening from said supply chamber;

and at least two return ports opening into said return chamber;

means adapting each of said supply and return ports for connection to the inlet and outlet, respectively, of a hot water heating medium; and means forming an aperture orifice in said divider wall positioned to enable restricted flow of water directly from said supply chamber to said return chamber.

7. The manifold defined by claim 6 wherein:

the diameter of said orifice is less than one-half the diameter of one of said supply and return ports.

8. The manifold defined by claim 7 wherein:

the diameter of said orifice is about one-third the diameter of one of said supply and return ports.

* * * * *